US006019353A

United States Patent [19]

Atfield

[11] Patent Number: 6,019,353

[45] Date of Patent: Feb. 1, 2000

[54] WINCH HAVING A MULTIPLE DIAMETER DRUM

[75] Inventor: Philip Atfield, Emsworth, United Kingdom

[73] Assignee: Lewmar Marine Limited, Hampshire, United Kingdom

[21] Appl. No.: 09/099,605

[22] Filed: Jun. 18, 1998

[30] Foreign Application Priority Data

Jun. 27, 1997 [GB] United Kingdom ..... 9713669

[51] Int. Cl.[7] ..... B66D 1/00

[52] U.S. Cl. ..... 254/278; 254/371; 254/374; 242/903

[58] Field of Search ..... 254/278, 374, 254/344, 295, 297, 371; 242/903

[56] References Cited

U.S. PATENT DOCUMENTS

| | | | |
|---|---|---|---|
| 29,990 | 9/1860 | Perley . | |
| 66,299 | 7/1867 | Coffin, Jr. . | |
| 234,714 | 11/1880 | Lotz . | |
| 255,844 | 4/1882 | Dobbie . | |
| 350,464 | 10/1886 | Manton . | |
| 398,502 | 2/1889 | Dyblie et al. . | |
| 410,507 | 9/1889 | Fain . | |
| 630,962 | 8/1899 | Wood . | |
| 841,420 | 1/1907 | Moore . | |
| 850,152 | 4/1907 | Grable . | |
| 1,162,392 | 11/1915 | Overly et al. . | |
| 1,235,504 | 7/1917 | Ross . | |
| 1,237,443 | 8/1917 | Aldrich . | |
| 1,421,183 | 6/1922 | Ditson . | |
| 1,424,990 | 8/1922 | Coyle et al. | 254/344 |
| 1,543,856 | 6/1925 | Lear . | |
| 1,565,720 | 12/1925 | Estes . | |
| 1,568,406 | 1/1926 | Le Bus . | |
| 1,816,654 | 7/1931 | Powers . | |
| 2,157,153 | 5/1939 | Troche . | |
| 2,328,133 | 8/1943 | Foster . | |
| 2,435,580 | 2/1948 | Glennon . | |
| 2,513,095 | 6/1950 | Hunt . | |
| 2,665,112 | 1/1954 | Ashton . | |
| 2,793,740 | 5/1957 | Daudt . | |
| 3,432,146 | 3/1969 | Schubert et al. . | |
| 3,642,253 | 2/1972 | Baldwin et al. . | |
| 4,386,760 | 6/1983 | Hutton | 254/344 |
| 4,662,609 | 5/1987 | Swenson . | |
| 5,829,736 | 11/1998 | Harken | 254/374 |

FOREIGN PATENT DOCUMENTS

| | | |
|---|---|---|
| 0759408 | 6/1922 | European Pat. Off. . |
| 719030 | 3/1942 | Germany . |
| 4302018 | 7/1994 | Germany . |
| 11048 | 4/1901 | United Kingdom . |
| 340427 | 1/1931 | United Kingdom . |
| 524115 | 7/1940 | United Kingdom . |
| 1178067 | 1/1970 | United Kingdom . |

OTHER PUBLICATIONS

Catalog: Author—Lewmar, Title: "Winches and Marine Hardware 1978/79," six pages.

*Primary Examiner*—Katherine A. Matecki

*Attorney, Agent, or Firm*—St. Onge Steward Johnston & Reens, LLC

[57] ABSTRACT

A winch has two portions of respectively different diameters. A ridge between them permits line to be flipped from the larger diameter portion to the other. Surface treatments of the two portions may be different, with that on the larger diameter portion being less aggressive than that on the smaller.

9 Claims, 2 Drawing Sheets

WINCH HAVING A MULTIPLE DIAMETER DRUM

FIELD OF THE INVENTION

This invention relates to winches and is concerned in particular to provide a winch with drum portions of at least two diameters onto either or any of which line may be wound.

BACKGROUND OF THE INVENTION

Multiple-diameter winch drums of the horizontal axis windlass type are commonplace in the art, and there are examples also of the free-end, vertical-axis, deck type. However, in the application of the multiple-diameter drum concept to free-end deck winches, which is the area with which we are particularly concerned and which are usually hand-powered, it is particularly important to have economy and efficiency of operation in the sense of requiring minimal attention by crew members when the winch is in operation.

Furthermore, all such winches known to us have very specifically required that the drum portions be separated by a lip which is designed and dimensioned to prevent line from transferring from one portion to the other.

SUMMARY OF THE INVENTION

In the present invention we aim to provide a winch drum for a free ended deck winch in which the transfer of line from a drum portion of one diameter to a drum portion of another diameter is permitted by the conformation of the drum.

The winch may have on its two or more diameters respectively different grip characteristics. We therefore can provide a two (or more) diameter winch of which the drum has different surface treatments on at least two portions of different diameter so as to afford different gripping characteristics in relation to a line wound upon them.

DESCRIPTION OF A PARTICULAR EMBODIMENT

Figure 1:
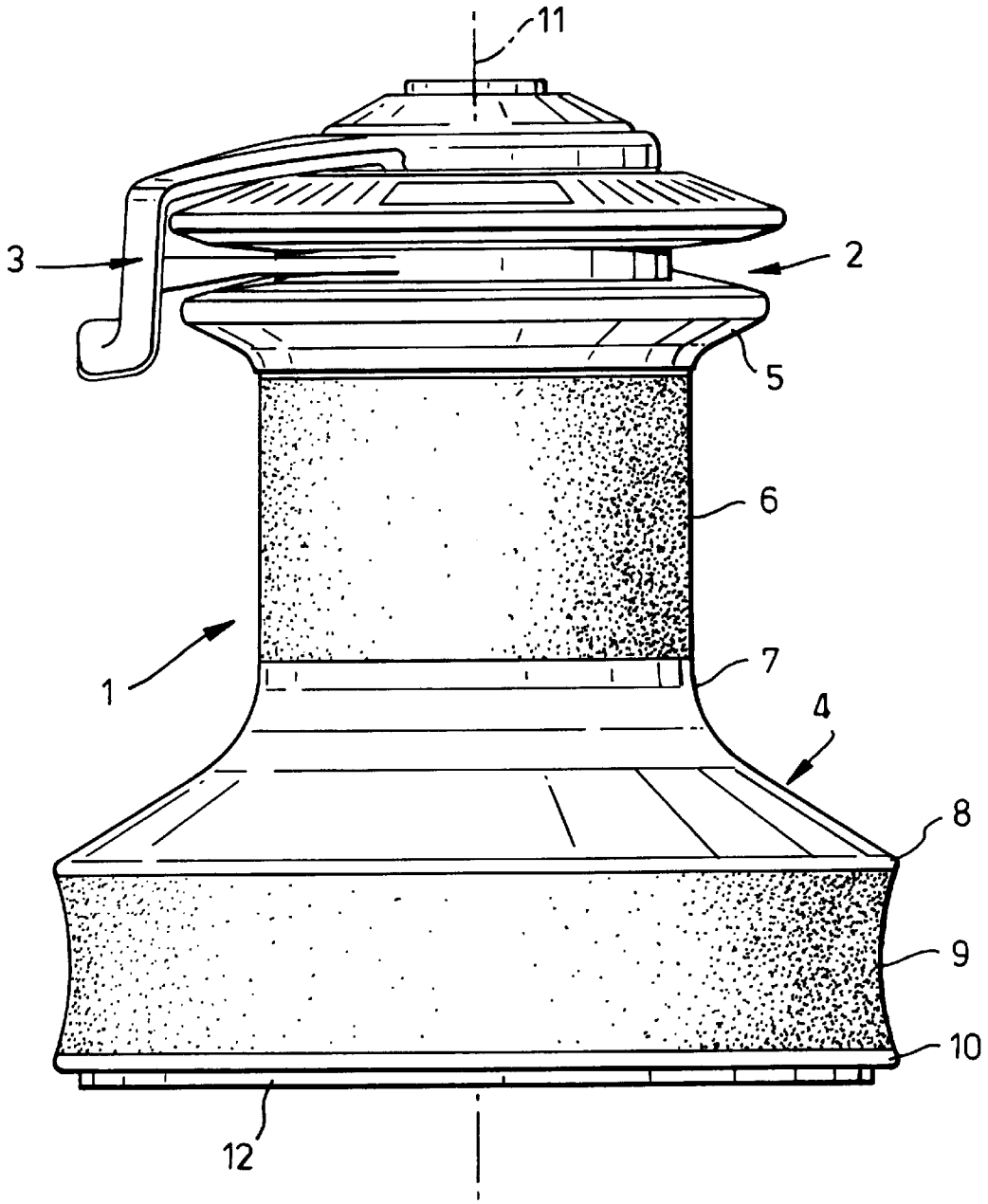
FIG. 1 shows a side view of a winch in accordance with a first embodiment of the present invention.

The internal structure and (if any) gearing of a winch 1 is conventional as is also a self-tailing channel 2 and a line guide and stripper arm 3.

The drum 4 of the winch is rotatable about axis 11 and has two main portions of respectively different effective diameters. Adjacent to the base 12 of the winch there is a first drum portion 9, of a diameter greater than that of a second portion 6, having a gripping surface and terminating in a lower ridge 10 at the base of the drum 4. Adjacent to and below the lower jaw 5 of the self-tailing channel is the second drum portion 6 which is cylindrical and has a gripping surface. Beyond its bottom end 7 there is a divergence outwardly to a ridge 8 below which is the first drum portion 9.

In this embodiment the portion 9 is not of a single diameter but is internally concave between the ridges 8 and 10, the degree of concavity being less than the diameter and preferably less than the radius of the line intended to be received on the winch.

For example in the winch shown, which is intended for line of a diameter from 8 to 14 mm, the minimum diameter of the portion 9 is 177 mm and the maximum diameter of the ridges 8 and 10 is 184 mm, thus giving a diametrical difference of 7 mm or a radial difference of 3.5 mm in the concavity, which is less than the 4 mm radius of the smallest line intended to be received by the winch, and half the radius (7 mm) of the largest line intended to be received.

The axial length of the portion 9 between the ridges 8 and 10 is in this embodiment 38 mm, the axial length from ridge 8 to lower jaw 5 being 112 mm with the cylindrical portion 6 being approximately 60 mm in axial length and having a diameter of 93 mm, that is to say a diameter of just over half the minimum diameter of the portion 9. Though other dimensions and shapes are possible for the various parts of the drum the ridge 8 should never be such as to prevent the transfer of line from one portion to another, and preferably will have a radial projection in relation to the major-diameter portion such as 9 which is less than the diameter, and more preferably less than the radius, of the thickness of the smallest line intended to be received by it and more preferably half or even less than half the radius of the thickness of the largest line intended to be received by the winch.

In other words, the dimension of a ridge such as 8 is chosen so that line on the major diameter portion such as 9 can be readily deliberately dislodged from that portion onto the smaller-diameter portion such as 6. Additionally or alternatively the ridge may be discontinuous.

Figure 2:
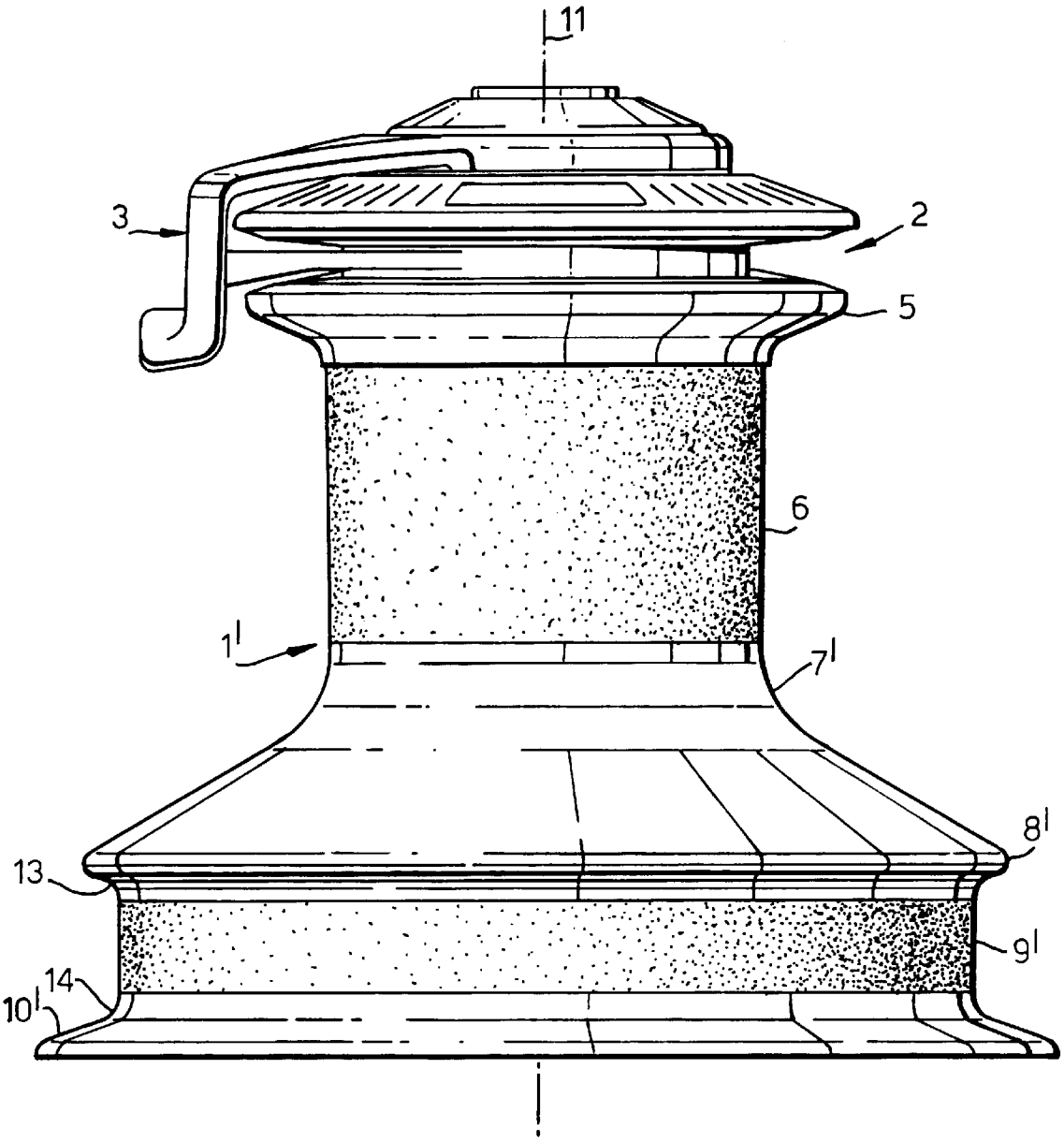
FIG. 2 shows a side view of a winch in accordance with a second embodiment of the present invention.

An example of different dimensioning and shape is seen in the winch 1' of FIG. 2.

Here, the lower portion 9' is largely cylindrical, with a rounded transition 13 to a ridge 8' which is more definite than ridge 8. Rounded transition 14 leads to a lower ridge 10' of considerably greater radial projection than the ridge 8'.

The radius of curvature of the transitions 13,14 is preferably the same, and is preferably equal to the radius of the median thickness line intended for use on the winch.

The radial projection of the ridge 8' beyond the main diameter of the portion 9' is as for the first embodiment, i.e. less than the diameter of the smallest line intended to be wound on the winch, and equal to or less than the radius of the thickness of the largest line intended to be wound on the winch.

The cylindricality of the portion 6 allows for the use of the self-tailing channel to be effective in relation to line wound on it with the tensioned run lowermost.

In use, the winch 1,1' is mounted by its base 12 to a deck with the axis 11 perpendicular to the deck. It can be used as an ordinary self-tailing winch with line first being placed around the drum portion 6 and into the self-tailing channel, and a drive applied to the drum in the usual way. Alternatively, line may be wound round the major-diameter portion 9,9' which is nearer to the deck, and the greater angular velocity of this portion upon a given drive input and (if provided) gear ratio within the winch allows a rapid take-up of line. Since tension from the line is being exerted at a greater radius from the axis of the winch drum there will come a time when the winch is not able to handle tension on that portion at a given drive or gear ratio. At that stage the crew member operating the winch has the choice of changing gear and continuing to wind on the major diameter portion 9,9' or, usually, to flip the line from portion 9,9' up onto portion 6 where greater advantage can be obtained on the line for a given drive ratio. If there is a light load and a single winding on the portion 9,9' he will be able to do this by simply lifting the taut line, taking a few turns of the loose end of the line around the portion 6 and into the self-tailing channel 2. If there is more than one turn on the portion 9,9' and/or a heavy load on the line, he will take a few turns round the portion 6, slacken off the line and then enter the loose run into the self-tailing channel. During slackening-off the line on portion 9 will tend to unwind and shift of its own accord over the ridge 8,8' to the smaller-diameter portion 6. In winch 1', curved transition 13 helps to prevent entrapment of the line below ridge 8'.

Line being handled by the major diameter part 9,9' will be subjected to higher surface and slipping speeds than line handled by the minor part. We therefore apply a different gripping surface to the portions 9,9' and 6 respectively with that on the portion 9,9' being less aggressive than that on the portion 6. For example the surface of the portion 6 can be achieved by roughening by a needle peening process. The lower portion 9,9' could be roughened by the same process but to a lesser extent. Alternatively it could be grit blasted.

The ridge 8 could include discontinuous parts of the same diameter as the minimum of portion 9, or the diameter of portion 9', or less, to allow deliberate passage of the line more easily to the lesser-diameter portion 6.

Drums of this description may be retrofitted to pre-existing winches of suitable dimensions, if desired.

I claim:

1. A winch for hauling a line, the winch comprising a drum rotatable about an axis of rotation, the drum engaging the line and comprising a first drum portion having a diameter and a second drum portion having a diameter smaller than the diameter of the first drum portion and a projection projecting between them radially of the axis, the line when on the drum being transferable past the projection from the first drum portion to the second drum portion, the drum portions having respectively different surface treatments, the surface treatment of the first drum portion giving a less aggressive grip than that of the second drum portion.

2. A winch according to claim 1, wherein the projection between the first and second drum portions is continuous and projects to a radial extent sufficient to prevent accidental but permit deliberate transfer of the line between drum portions.

3. A winch according to claim 2, wherein the first drum portion has a surface of concave cross-section when taken along the axis of rotation.

4. A winch according to claim 2 further comprising adjacent the second drum portion a self-tailing channel and guide.

5. A winch according to claim 4 further comprising a means for mounting the winch to a deck with the axis of rotation of the drum perpendicular to the deck and the first drum portion nearest to the deck and the self tailing channel and guide distal of the deck.

6. A winch comprising a drum rotatable about an axis of rotation and a line wound on the drum, the drum engaging the line to be hauled and comprising a first drum portion having a diameter and a second drum portion having a diameter smaller than the diameter of the first drum portion and a projection projecting between them radially of the axis, the projection projecting to a radial extent such that the line is transferable past the projection from the first drum portion to the second drum portion, the radial extent of the projection beyond the first drum portion being less than the radius of the line, the drum portions having respectively different surface treatments, the surface treatment of the first drum portion giving a less aggressive grip than that of the second drum portion.

7. A winch according to claim 6, wherein the first drum portion has a surface of concave cross-section taken along the axis of rotation and said extent of projection is measured from the minimum radius of said concave cross-sectioned surface.

8. A winch according to claim 7, wherein the radial extent of the projection is at most half that of the radius of the line.

9. A winch according to claim 6, wherein the radial extent of the projection is at most half that of the radius of the line.

* * * * *